US008375908B2

(12) United States Patent
Kim

(10) Patent No.: US 8,375,908 B2
(45) Date of Patent: Feb. 19, 2013

(54) APPARATUS FOR PREVENTING OIL FROM DRAINING IN ENGINE HAVING HLA

(75) Inventor: Jae Chun Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 658 days.

(21) Appl. No.: 12/606,016

(22) Filed: Oct. 26, 2009

(65) Prior Publication Data

US 2010/0126452 A1 May 27, 2010

(30) Foreign Application Priority Data

Nov. 24, 2008 (KR) ..... 10-2008-0117138

(51) Int. Cl.
*F01M 1/06* (2006.01)

(52) U.S. Cl. ..... 123/90.33; 123/196 R; 123/196 M

(58) Field of Classification Search ..... 123/90.33, 123/196 R, 196 M, 90.12, 90.13
See application file for complete search history.

(56) References Cited

U.S. PATENT DOCUMENTS 4,441,465 A * 4/1984 Nakamura ..... 123/90.34
4,729,349 A * 3/1988 Sonoda et al. ..... 123/90.34
5,161,495 A * 11/1992 Saito ..... 123/90.33
5,913,293 A * 6/1999 Ochiai ..... 123/90.33

FOREIGN PATENT DOCUMENTS

JP 3-38403 Y2 8/1991
JP 4-124417 A 4/1992
JP 10-299446 A 11/1998
JP 2007-187135 A 7/2007

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

An apparatus for preventing oil from draining in an engine oil supply system, which supplies the oil from a main gallery in an engine to diverge into a first oil pipe communicating with an intake side hydraulic lash adjuster and into a second oil pipe communicating with an exhaust side hydraulic lash adjuster, may include an adaptor installed between the first oil pipe and a main oil passage connected to the main gallery, wherein the adaptor is disposed higher than the first oil pipe so as to prevent the oil from draining back, and wherein the second oil pipe is communicated with the mail oil passage through a connection pipe.

10 Claims, 6 Drawing Sheets

APPARATUS FOR PREVENTING OIL FROM DRAINING IN ENGINE HAVING HLA

CROSS-REFERENCE TO RELATED APPLICATION

The present application claims priority to Korean Patent Application Number 2008-0117138 filed on Nov. 24, 2008, the entire contents of which application is incorporated herein for all purposes by this reference.

BACKGROUND OF THE INVENTION

1. Field of the Invention

The present invention relates to an apparatus for preventing oil from draining and, more particularly, to an apparatus for preventing oil from draining in an engine having a Hydraulic Lash Adjuster (HLA), in which oil supplied to various parts of a cylinder head including the HLA does not drain back to a main gallery when the engine is stopped and thus can be reliably supplied to the engine when the engine is restarted.

2. Description of Related Art

An automotive engine includes sliding parts such as a cylinder and a piston and rotating parts such as a crankshaft and a camshaft. These operating parts generate frictional heat through direct contact between metal members, such that roughened frictional surfaces will prematurely wear and, in severe cases, be bonded with each other due to the frictional heat. These problems cause severe trouble to the operation of the engine.

In order to prevent such problems, the automotive engine is equipped with a lubrication system. The lubrication system injects oil into various parts of the engine, which come into direct contact with each other, to thereby form an oil film thereon. The oil film can reduce wear and temperature rise by decreasing frictional resistance.

FIG. 1 is a schematic block diagram illustrating oil passages of a conventional engine lubrication system, and FIG. 2 is a perspective view illustrating conventional oil passages for supplying oil to Hydraulic Lash Adjusters (HLAs) and a cam shaft.

As shown in FIGS. 1 and 2, in the engine lubrication system, an oil pump 2 is provided to force oil from an oil pan 1 to various engine parts to be lubricated, and an oil filter 3 is provided on an oil supply line to filter impurities from oil, which is forced by the oil pump 2.

Oil is forced by the oil pump 2 into an oil gallery or main gallery 4 of a cylinder block, in which oil will lubricate bearing parts of a crankshaft and connecting rods. Then, oil is also supplied from the main gallery 4 to a cylinder head 11 via a non-return valve 10, which is also referred to as a check valve.

From the cylinder head 11, oil is supplied to HLAs 20 and Continuously Variable Valve Timing (CVVT) systems as well as camshaft bearings.

However, when an automobile having the engine provided with the HLAs as described above is not run for a long time, oil supplied to various parts of the cylinder head including the HLAs returns to the main gallery. Then, oil will not be instantaneously supplied to the HLAs and other parts of the cylinder head when the engine is restarted. This causes problems such as heavy noise, premature wear and damage to the engine.

Of course, as shown in FIG. 1, a non-return valve can be installed to prevent oil from returning to the main gallery from the cylinder head when the engine is stopped. In this case, however, an additional valve has to be installed on an oil supply circuit. Furthermore, when the engine is run for a long time, the non-return valve may not operate properly due to sticking.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an improved structure of oil passages without installing an additional part such as a non-return valve between a main gallery and a cylinder head, such that oil does not return to the main gallery from various parts of the cylinder head including Hydraulic Lash Adjusters (HLAs) even if an engine is stopped, in order to prevent the various parts of the cylinder heads including the HLAs from being damaged when the engine is restarted.

In an aspect of the present invention, the apparatus for preventing oil from draining in an engine oil supply system, which supplies the oil from a main gallery in an engine to diverge into a first oil pipe communicating with an intake side hydraulic lash adjuster and into a second oil pipe communicating with an exhaust side hydraulic lash adjuster, may include an adaptor installed between the first oil pipe and a main oil passage connected to the main gallery, wherein the adaptor is disposed higher than the first oil pipe so as to prevent the oil from draining back, and wherein the second oil pipe is communicated with the mail oil passage through a connection pipe.

The adaptor may include a drain-preventing passage connecting the mail oil passage and the first oil pipe, the drain-preventing passage being bent upwards at least once to form a highest portion thereof, and the first oil pipe being disposed lower than the highest portion of the drain-preventing passage such that the oil supplied from the main oil passage rises above the highest portion and then descends to enter the first oil pipe.

One end portion of the connection pipe may be connected to the second oil pipe and the other end portion thereof is connected to the main oil passage at a predetermined portion between the main gallery and the highest portion of the drain preventing passage, wherein the one end portion of the connection pipe is inclined downwards with a predetermined angle with respect to the other end portion thereof.

One end portion of the connection pipe may be connected to the second oil pipe and the other end portion of the connection pipe is connected to the drain-preventing passage at a predetermined portion under the highest portion of the drain preventing passage, wherein the one end portion of the connection pipe is inclined downwards with a predetermined angle with respect to the other end portion thereof.

In another aspect of the present invention, the drain-preventing passage may be provided between a body of a cylinder head and a cover detachably mounted to the body, wherein the cover includes a slot to form the drain-preventing passage therein.

In further another aspect of the present invention, the main oil passage may communicate with the connection pipe at a predetermined portion between the main gallery and a highest portion of the adaptor, wherein the connection pipe is inclined downwards at a predetermined angle and is placed below the predetermined portion between the main gallery and the highest portion, wherein the adaptor is provided between a body of the cylinder head and a cover detachably mounted to the body, and wherein the cover includes a slot to form the adaptor therein.

As set forth above, embodiments of the present invention make it possible to prevent oil from returning to the main gallery from the cylinder head when the engine is stopped without installing a check valve such as a non-return valve in the cylinder head, in which a variety of devices such as the HLAs are provided. As a result, when the engine is restarted, corresponding parts can be quickly lubricated and thus noise and engine damage can be significantly reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
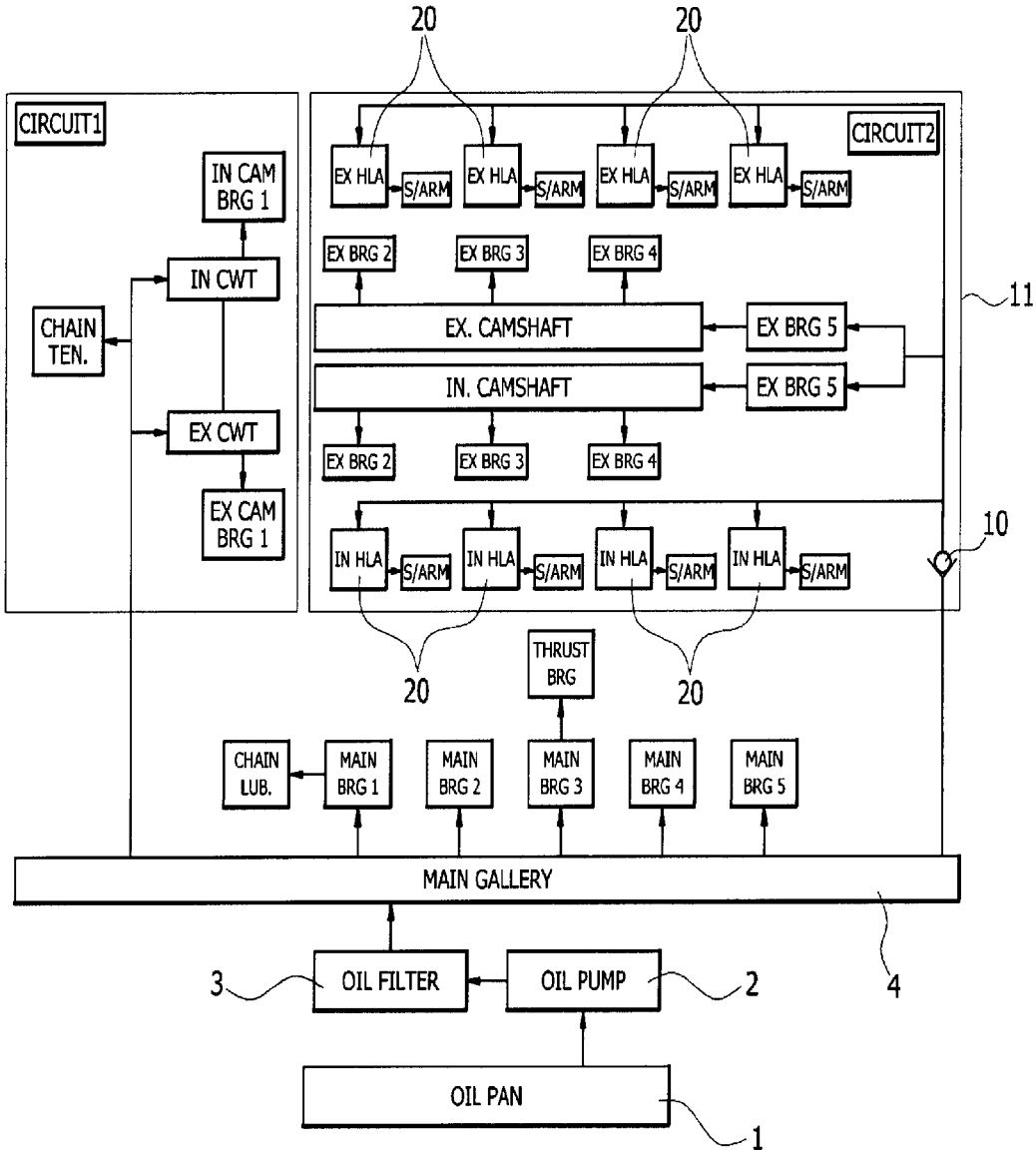
FIG. 1 (Prior Art)
FIG. 1 is a schematic block diagram illustrating oil passages of a conventional engine lubrication system.
Figure 2:
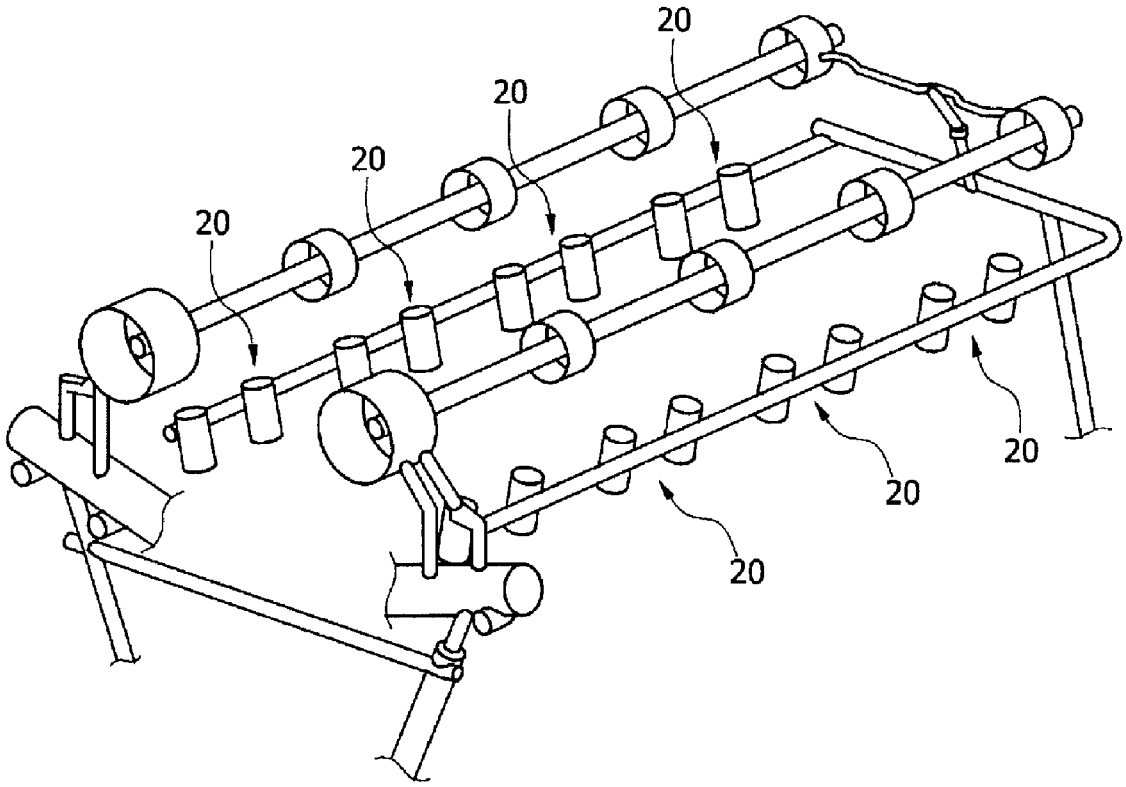
FIG. 2 is a perspective view illustrating conventional oil passages for supplying oil to Hydraulic Lash Adjusters (HLAs) and a cam shaft.
Figure 3:
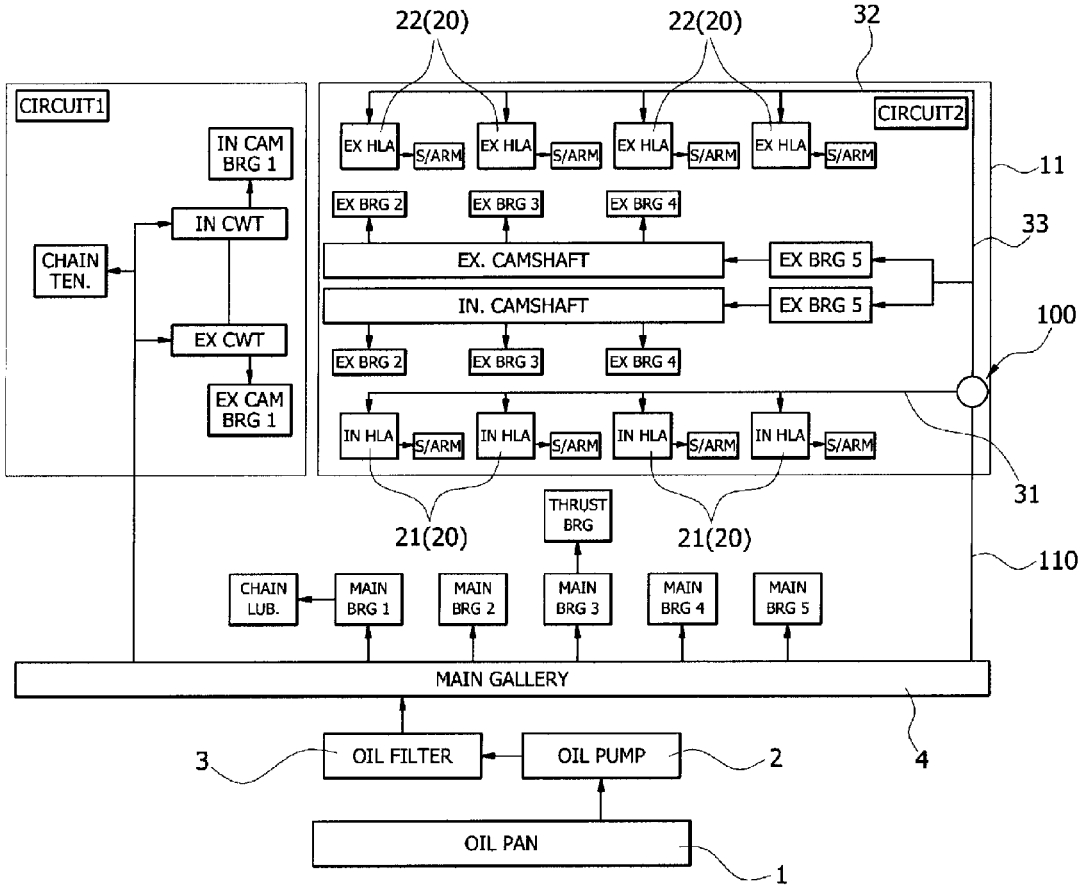
FIG. 3 is a schematic block diagram illustrating oil passages of an exemplary engine lubrication system according to the present invention.
Figure 4:
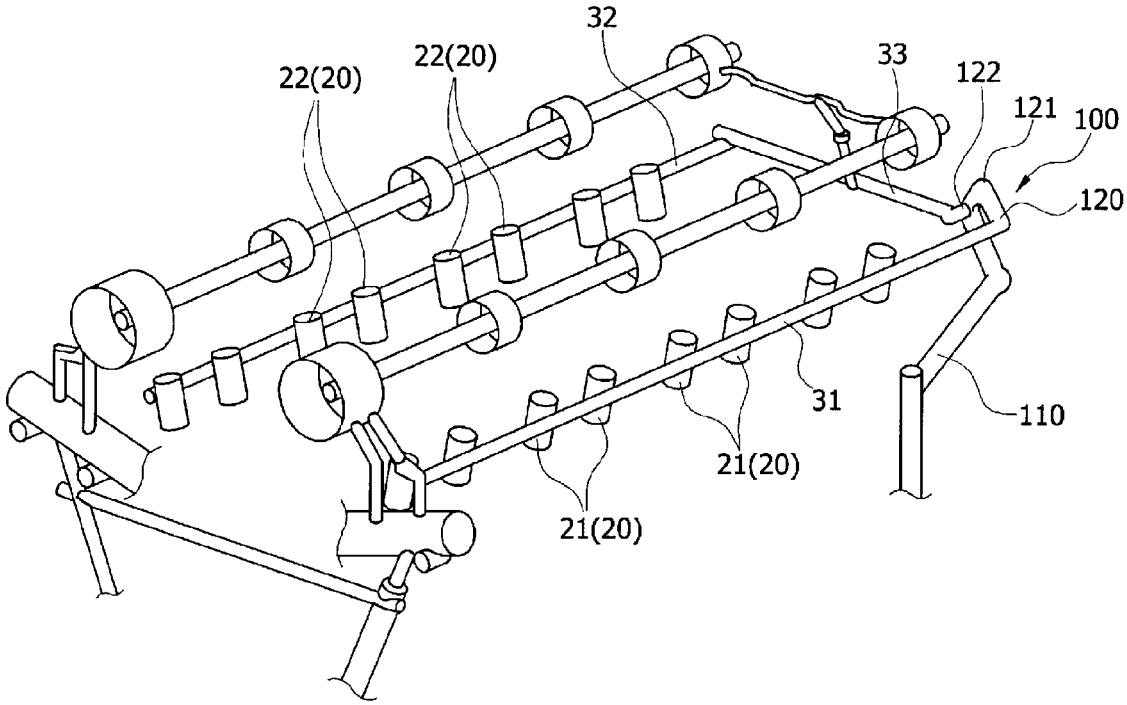
FIG. 4 is a perspective view illustrating oil passages for supplying oil to an exemplary engine having HLAs and an exemplary structure for preventing oil from draining according to the present invention.
Figure 5:
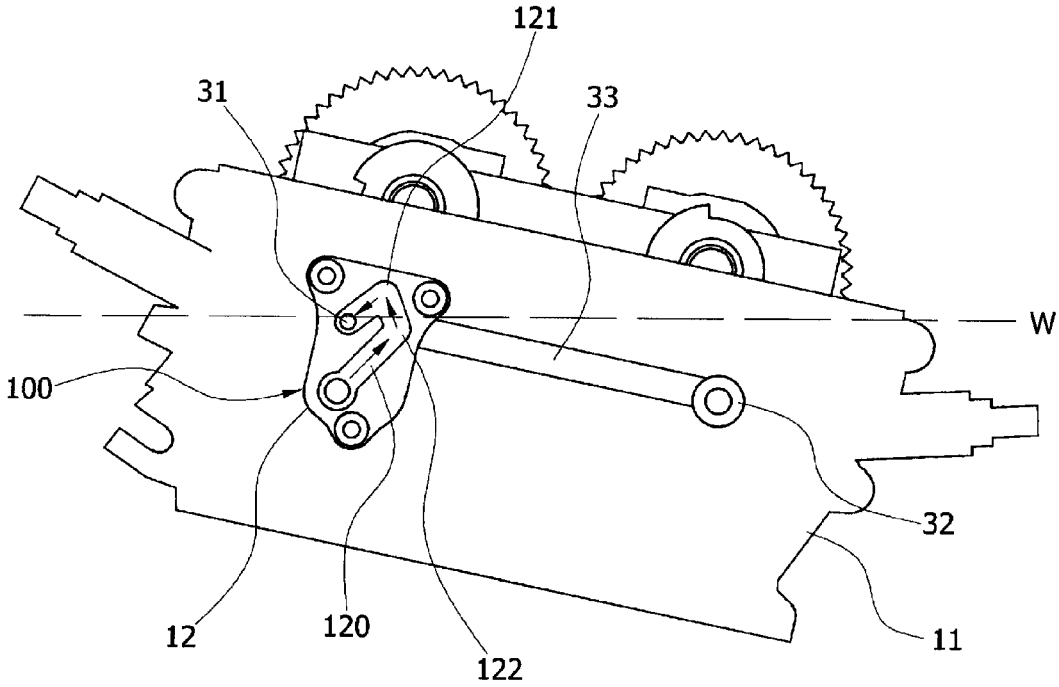
FIG. 5 is a front elevation view illustrating a drain-preventing passage of an exemplary apparatus for preventing oil from draining according to the present invention.
Figure 6:
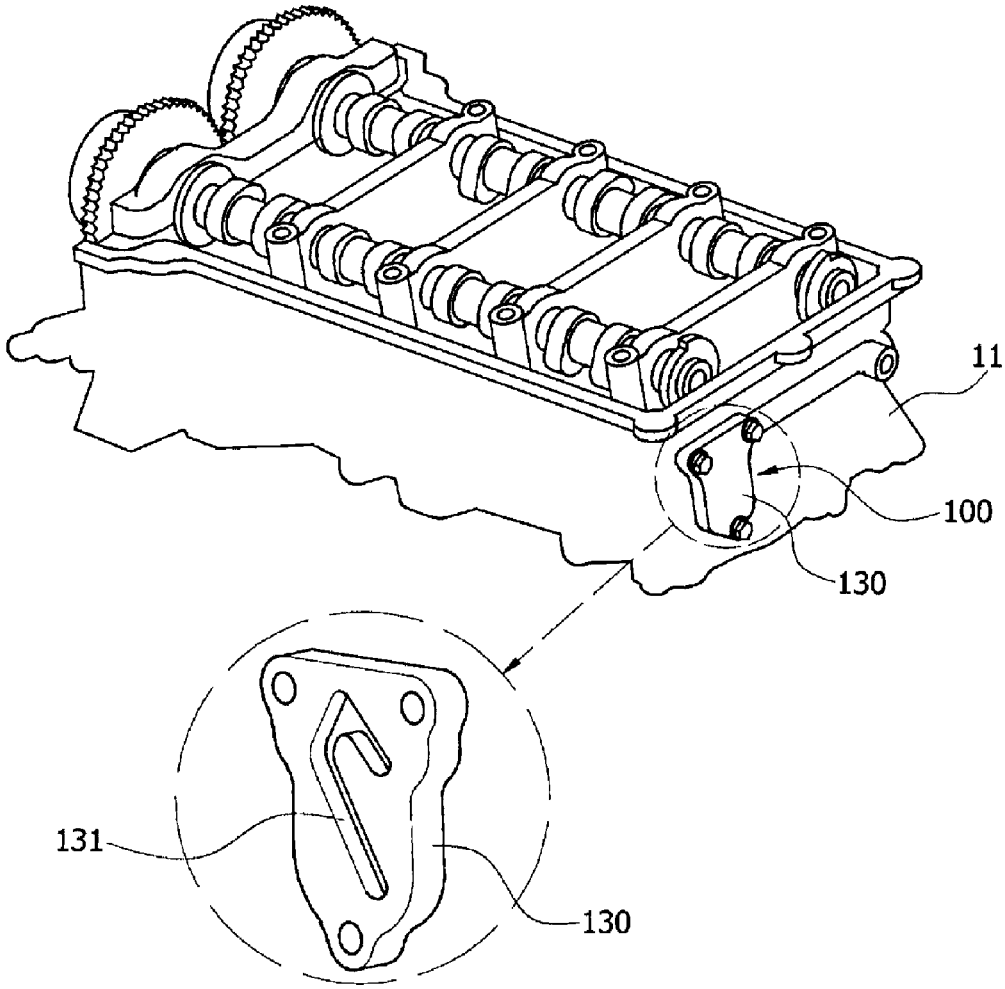
FIG. 6 is a perspective view illustrating an exemplary cylinder head of an engine in which the apparatus for preventing oil from draining according to the present invention is installed.

FIG. 3 is a schematic block diagram illustrating oil passages of an engine lubrication system according to various embodiments of the present invention, FIG. 4 is a perspective view illustrating oil passages for supplying oil to an engine having HLAs and a structure for preventing oil from draining according to various embodiments of the present invention, FIG. 5 is a front elevation view illustrating a drain-preventing passage of an apparatus for preventing oil from draining according to various embodiments of the present invention, and FIG. 6 is a perspective view illustrating a cylinder head of an engine in which the apparatus for preventing oil from draining according to various embodiments of the present invention is installed.

Firstly, referring to FIG. 3, as described in part above in the Description of the Related Art, an oil pump 2 is adapted to force oil from an oil pan 1 into a main gallery 4 in a cylinder block, from which oil is supplied to various engine parts. Of the oil passages, only an oil passage feeding a cylinder head 11 will be described herein.

Oil is supplied from the main gallery 4 through an oil passage in the cylinder block to the cylinder head 11, from which oil is introduced through an oil drain preventing apparatus 100 of the present invention to intake and exhaust Hydraulic Lash Adjusters (HLAs) 21 and 22.

This structure is more specifically illustrated in FIG. 4. As shown in FIG. 4, devices such as the HLAs 20 (21 and 22) and Continuously Variable Valve Timing (CVVT) systems, which have to be lubricated by oil, are installed in the cylinder head 11.

The HLAs 20 and the CVVT systems are divided into those arranged in the side of an intake manifold and those arranged in the side of an exhaust manifold. For the sake of brevity, those in the side of the intake manifold are referred to as the intake HLAs 21 and the intake CVVT system, and those in the side of the exhaust manifold are referred to as the exhaust HLAs 22 and the exhaust CVVT system.

Here, an oil passage designed to supply oil to the intake HLAs 21 is referred to as a first oil pipe 31, and an oil passage designed to supply oil to the exhaust HLAs 22 is referred to as a second oil pipe 32. When the engine is started, the oil pump 2 forces oil from the main gallery 4 through the main oil passage 110 to diverge into the first oil pipe 31 and into a connection pipe 33 connected to the second oil pipe 32, respectively.

An adaptor for preventing oil from draining is installed on the main oil passage 110 connecting the main gallery 4 with the first oil pipe 31. The adaptor has a drain-preventing passage 120, which is bent at least once such that oil rises above the first oil pipe 31 and then descends from the bent portion before entering the first oil pipe 31.

As shown in FIG. 4, due to the structure of the drain-preventing passage 120, oil supplied from the main gallery 4 enters the first oil pipe 31 by rising to a position higher than the first oil pipe 31 and then descending from the higher position. When the engine is running, oil can be properly supplied to the first oil pipe 31 since the oil pump 2 supplies oil under a sufficient pressure.

When the engine is stopped while oil is being supplied, oil present in one portion of the drain-preventing passage 120, upstream of a highest portion 121, returns to the main gallery 4 since oil is not supplied any further. In contrast, oil present in the other portion of the drain-preventing passage 120, downstream of the highest portion 121, remains in the first oil pipe 31 instead of returning to the main gallery 4 since it cannot flow over the highest portion 121 without an external force.

As a result, even if the engine is stopped for a relatively long time, oil can remain in the first oil passage 31 so as to quickly lubricate the HLAs 20 when the engine is restarted.

In the meantime, it is also required to supply oil in the main passage 110 towards the connection pipe 33 connected to the second oil pipe 32. For this, the main passage 110 is configured to communicate with the second oil pipe 32 at a connecting portion 122 between the main gallery 4 and the highest portion 121.

Here, oil may return from the second oil passage 32 to the main gallery 4 when the engine is stopped. In order to prevent this, as shown in FIG. 5, the cylinder head 11 is preferably inclined with respect to the horizon w such that the second oil pipe 32 is located below the connecting portion 122 between the main gallery 4 and the highest portion 121.

Since the cylinder head 11 is inclined such that the second oil pipe 32 is located below the connecting portion 122 between the main gallery 4 and the highest portion 121, the connection pipe 33 connected with the drain-preventing passage 120 accordingly has a downward inclination such that oil can remain inside the second oil pipe 32 instead of returning to the main gallery 4 from the second oil pipe 32 even if the engine is stopped.

In various embodiments of the present invention, one end portion of the connection pipe 33 may be connected to the second oil pipe 32 and the other end portion thereof may be connected to the main oil passage 110 at a predetermined portion between the main gallery 4 and the highest portion 121 of the drain preventing passage 120, wherein the one end portion of the connecting pipe 33 may be inclined downwards with a predetermined angle with respect to the other end portion thereof In other embodiments of the present invention, one end portion of the connection pipe 33 may be connected to the second oil pipe 32 and the other end portion of the connection pipe 33 may be connected to the drain-preventing passage 120 at a predetermined portion under the highest portion of the drain preventing passage 120, wherein the one end portion of the connecting pipe 33 is inclined downwards with a predetermined angle with respect to the other end portion thereof.

As set forth above, when the engine is stopped, oil remains inside the first oil pipe 31 instead of returning to the main gallery 4 since it cannot flow over the highest portion 121 of the drain-preventing passage 120. Further, oil also remains inside the second oil pipe 32 instead of returning to the main gallery 4 since the second oil pipe 32 extends at a downward inclination from the connecting portion 122.

Referring to FIG. 6, the drain-preventing passage 120 can be provided between a body 12 of the cylinder head 11 and a cover 130 detachably mounted to the body 12. Preferably, the cover 130 can have a slit 131 that forms part of the drain-preventing passage 120.

For convenience in explanation and accurate definition in the appended claims, the terms "upper", "lower" and "downward" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for preventing oil from draining in an engine oil supply system, which supplies the oil from a main gallery in an engine to diverge into a first oil pipe communicating with an intake side hydraulic lash adjuster and into a second oil pipe communicating with an exhaust side hydraulic lash adjuster, the apparatus comprising:

an adaptor installed between the first oil pipe and a main oil passage connected to the main gallery, wherein the adaptor is disposed higher than the first oil pipe so as to prevent the oil from draining back;

wherein the second oil pipe is communicated with the mail oil passage through a connection pipe;

wherein the adaptor comprises a drain-preventing passage connecting the mail oil passage and the first oil pipe, the drain-preventing passage being bent upwards at least once to form a highest portion thereof, and the first oil pipe being disposed lower than the highest portion of the drain-preventing passage such that the oil supplied from the main oil passage rises above the highest portion and then descends to enter the first oil pipe; and wherein one end portion of the connection pipe is connected to the second oil pipe and the other end portion thereof is connected to the main oil passage at a predetermined portion between the main gallery and the highest portion of the drain preventing passage.

2. The apparatus according to claim 1, wherein the one end portion of the connection pipe is inclined downwards with a predetermined angle with respect to the other end portion thereof.

3. The apparatus according to claim 1, wherein one end portion of the connection pipe is connected to the second oil pipe and the other end portion of the connection pipe is connected to the drain-preventing passage at a predetermined portion under the highest portion of the drain preventing passage.

4. The apparatus according to claim 3, wherein the one end portion of the connection pipe is inclined downwards with a predetermined angle with respect to the other end portion thereof.

5. The apparatus according to claim 1, wherein the drain-preventing passage is provided between a body of a cylinder head and a cover detachably mounted to the body.

6. The apparatus according to claim 5, wherein the cover includes a slot to form the drain-preventing passage therein.

7. The apparatus according to claim 1, wherein the main oil passage communicates with the connection pipe at a predetermined portion between the main gallery and a highest portion of the adaptor.

8. The apparatus according to claim 7, wherein the connection pipe is inclined downwards at a predetermined angle and is placed below the predetermined portion between the main gallery and the highest portion.

9. The apparatus according to claim 7, wherein the adaptor is provided between a body of the cylinder head and a cover detachably mounted to the body.

10. The apparatus according to claim 9, wherein the cover includes a slot to form the adaptor therein.

* * * * *